US006699162B2

(12) United States Patent
Chen

(10) Patent No.: US 6,699,162 B2
(45) Date of Patent: Mar. 2, 2004

(54) EXERCISE APPARATUS

(76) Inventor: Philip Chen, 1535 Lake St., San Francisco, CA (US) 94118

( * ) Notice: Subject to any disclaimer, the term of this patent is extended or adjusted under 35 U.S.C. 154(b) by 81 days.

(21) Appl. No.: 10/105,567

(22) Filed: Mar. 26, 2002

(65) Prior Publication Data

US 2003/0186793 A1 Oct. 2, 2003

(51) Int. Cl.[7] ..... A63B 26/00; A63B 1/00
(52) U.S. Cl. ..... 482/140; 482/907; 482/38
(58) Field of Search ..... 482/140, 121–123, 482/128–130, 141–142, 907, 38–42

(56) References Cited

U.S. PATENT DOCUMENTS

| | | | | | |
|---|---|---|---|---|---|
| 3,735,979 | A | * | 5/1973 | Levenberg | 482/143 |
| 3,857,561 | A | * | 12/1974 | Cecchettini et al. | 482/142 |
| 4,458,894 | A | * | 7/1984 | Dudley | 482/40 |
| 5,156,580 | A | * | 10/1992 | Holland et al. | 482/39 |
| 5,320,591 | A | * | 6/1994 | Harmon et al. | 482/129 |
| 5,567,202 | A | * | 10/1996 | Hager | 482/131 |
| 5,810,702 | A | * | 9/1998 | Wilkinson | 482/142 |

* cited by examiner

*Primary Examiner*—Jerome W. Donnelly
*Assistant Examiner*—Fenn C Mathew

(57) ABSTRACT

Exercise apparatus with a base plate, a pair of opposed flanges extending perpendicularly from the end and side of the base plate, each the flange having a an aperture that receives a pin that acts as a shaft, an inverted U shaped frame, the ends of the U shaped frame being connected to the shaft pins so that the U shaped frame can rotate about the shaft pins, a plurality of radially spaced apertures in each the flange, a single aperture in each said inverted U shaped frame that aligns with said radially spaced apertures, a pair of connecting pins to retain said inverted U shaped frame to said flanges in a fixed position with respect to said base plate, a foot retaining assembly slidibly mounted in a horizontal manner with respect to the base of said inverted U shaped frame, said foot retaining assembly comprised of a plurality of foot retaining bars attached at each end to a side plate, a pair of retaining pins that can fix said foot retaining assembly higher or lower along said inverted U shaped frame. A preferred embodiment includes wherein a pair of guide rods can be inserted so that they extend horizontally out from said flanges to the front edge of said base plate. A preferred embodiment includes wherein said guide rails can slidably retain a resilient exercise ball in a linear rolling fashion.

4 Claims, 5 Drawing Sheets

EXERCISE APPARATUS

BACKGROUND OF THE INVENTION

This invention relates generally to the field of exercise equipment, and more particularly to an exercise apparatus to be used in conjunction with a resilient exercise ball.

Exercise devices of many Kinds have been developed over the years to help people tone, strengthen and stretch various parts of the body.

To this end, exercise equipment has been designed that helps a person get into positions that facilitate the flexing of particular body parts. More recently the use of resilient balls have been marketed to exercise enthusiasts where the user is advised to incorporate the ball into various stretching and strengthening exercise routines. These balls tend to be about twenty four inches in diameter and are inflated and made of a resilient vinyl material. To use the ball, the user places a part of his or her body over the ball and performs a stretching or contracting activity.

Although the existing exercise balls have proven to be beneficial to those who wish to stretch and tone various body parts, there are certain deficiencies that can occur when using an exercise ball without additional support. First, when a person does an exercise that requires that he or she roll their back or front on the ball in a forward and backward manner, there is a tendency to roll off the ball if the user is not careful.

Additionally, there are some exercises that can not be properly practiced on a ball without the aid of a foot or hand retaining bar to help the user hold their hands or feet in an ideal position while exercising with the ball. Without an additional apparatus that can be used in conjunction with the exercise ball, many beneficial exercises can not be performed.

SUMMARY OF THE INVENTION

The primary object of the invention is To provide an exercise apparatus that can be used in conjunction with a resilient ball to allow the user to do a plurality of stretch and compression exercises.

Another object of the invention is to provide an exercise apparatus that has an adjustable frame that allows the user to perform a variety of exercises.

Another object of the invention is to provide an exercise apparatus that folds down flat for easy storage and shipping.

A further object of the invention is to provide an exercise apparatus that guides a resilient ball in a linear direction.

Other objects and advantages of the present invention will become apparent from the following descriptions, taken in connection with the accompanying drawings, wherein, by way of illustration and example, an embodiment of the present invention is disclosed.

An exercise apparatus comprising: a base plate, a pair of opposed flanges extending perpendicularly from the end and side of said base plate, each said flange having a an aperture that receives a pin that acts as a shaft, an inverted U shaped frame, the ends of said U shaped frame being connected to said shaft pins so that said U shaped frame can rotate about said shaft pins, a plurality of radially spaced apertures in each said flange, a single aperture in each said inverted U shaped frame that aligns with said radially spaced apertures, a pair of connecting pins to retain said inverted U shaped frame to said flanges in a fixed position with respect to said base plate, a foot retaining assembly slidibly mounted in a horizontal manner with respect to the base of said inverted U shaped frame, said foot retaining assembly comprised of a plurality of foot retaining bars attached at each end to a side plate, said side plate having a frame retaining connector, said retaining connector having an aperture that can align with one of a plurality of spaced apertures located in each leg of said inverted U shaped frame, a pair of retaining pins that can fix said foot retaining assembly higher or lower along said inverted U shaped frame, and said foot retaining bars being adjustable to allow for different sized feet.

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
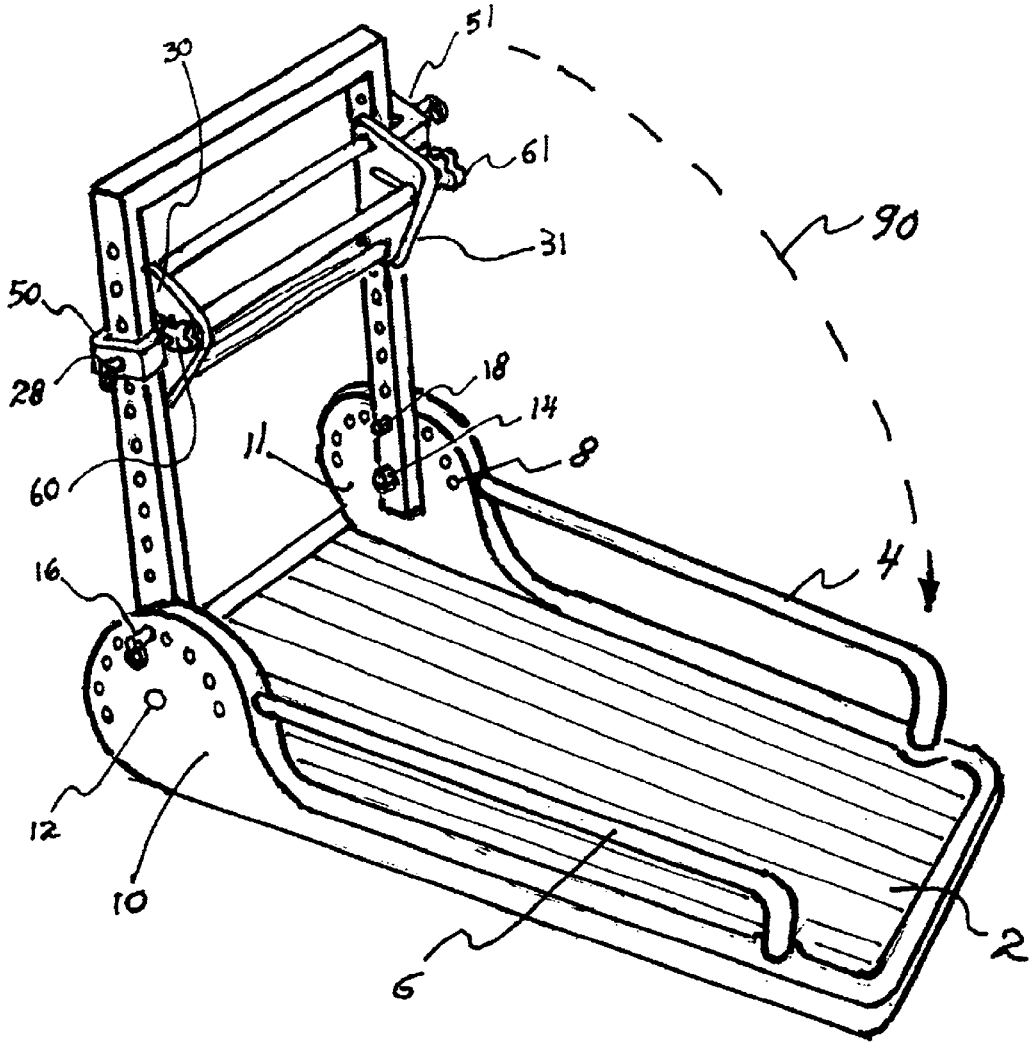
FIG. 1 us a perspective view of the exercise apparatus of the present invention

Referring now to FIG. 1 we see a perspective view of the exercise apparatus of the present invention 100. Base plate 2 sits firmly on a floor Flanges 10, 11 extend in a perpendicular fashion at the far end edges of base plate 2. An inverted U shaped frame is comprised of two legs 20, 22 and cross bar 24. The free ends of legs 20, 24 are pinned at shaft points 12, 14 so that the inverted U shaped frame can rotate. The frame legs are held in one of a plurality of positions by removable replaceable pins 16, 18 as they interact with apertures 40, 8 located in the flanges 10, 11 Foot and hand rest assembly 200 is comprised of a plurality of horizontally disposed bars 32,34, 36 removably attached to side plates 30, 31. Slidable sleeve 50 is fixedly attached to side plate 30 and a similar sleeve 51 is attached to outside of side plate 31. Retaining pins 28, 29 can be removed to slide foot and hand assembly 200 down or up and then replaced to hold assembly 200 in a fixed position. Guide rails 4, 6 are attached to flanges 10, 11 at one end and to the front of base plate 2 at the opposite end. The spacing of the guide rails 4, 6 is such that they slidably retain a resilient exercise ball as will be shown in the following Figures. Guide rails 4, 6 can be removed once the user becomes proficient in using the present invention. Foot retaining bar 34 can be moved in or out by loosening knobs 60, 61 and sliding bar 34 along slits in side plates 30, 31 thereby allowing for different sized feet. Dotted line 90 indicates how the inverted U frame 22, 24, 20 can fold down for compact storage and shipping.

Figure 2:
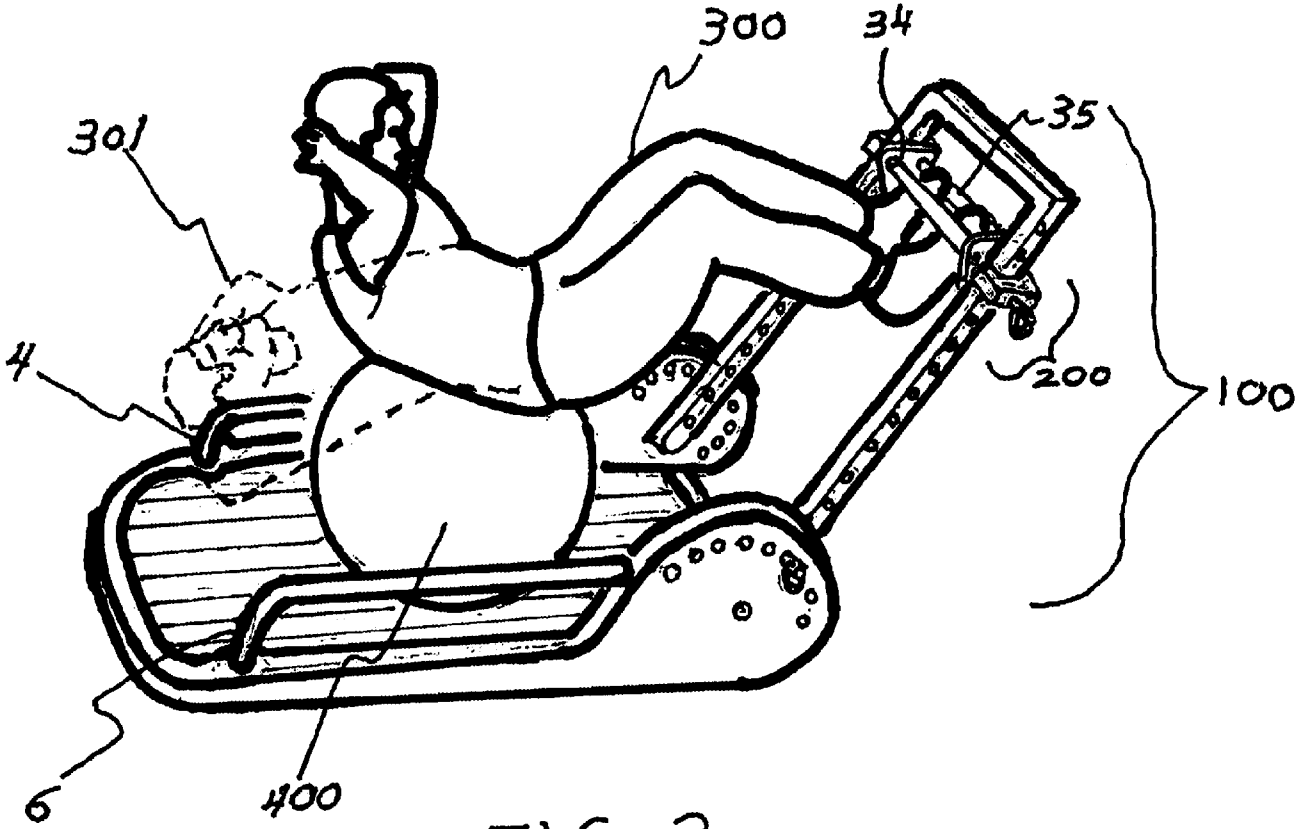
FIG. 2 is a perspective view of a person performing a modified sit-up using the present invention.

FIG. 2 shows a perspective view of a person 300 performing a modified sit-up using the present invention 100. The user's feet are retained by bar 34 in assembly 200. Dotted line 301 shows the user in the downward position. Ball 400 is steadied and retained by guide rails 4. 6. In this way, by taking advantage of the present invention 100, the user can have his or her feet in an ideal position while performing sit-ups using resilient ball 400.

Figure 3:
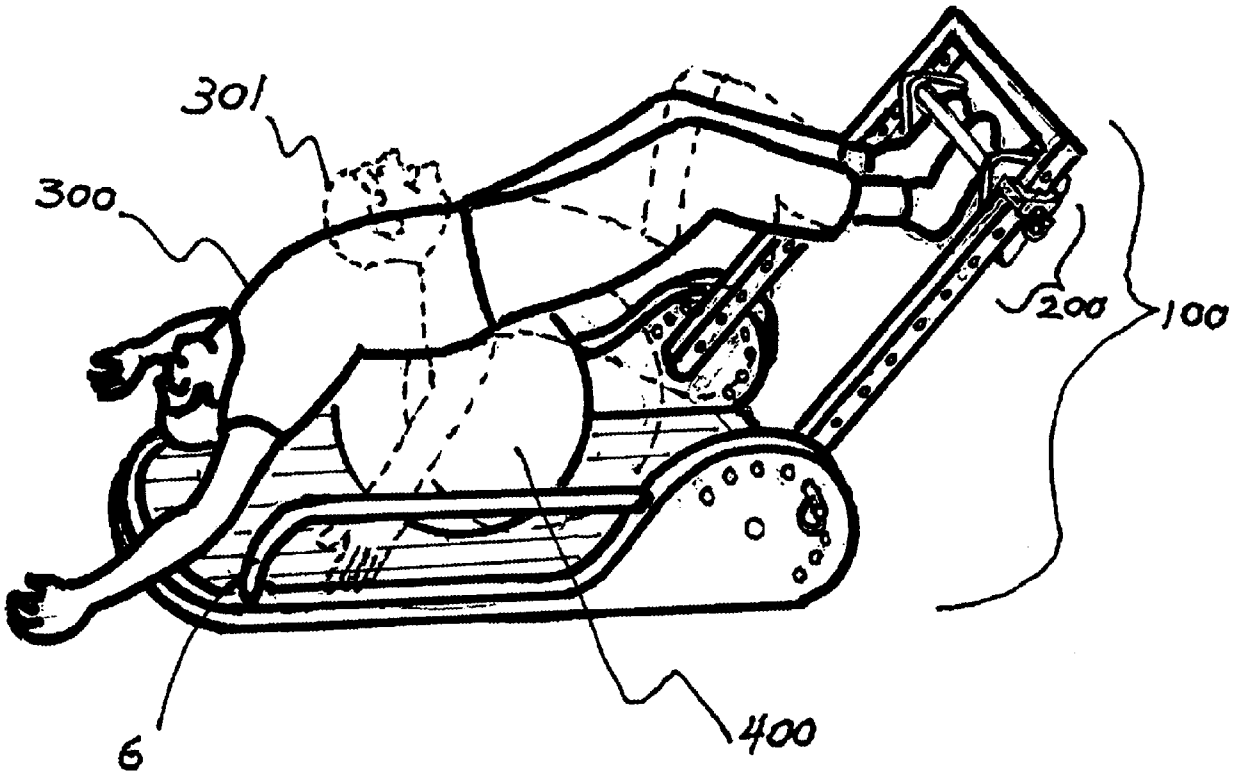
FIG. 3 is a perspective view of a person performing a rolling leg bend using the present invention.

FIG. 3 shows a person 300 performing a leg bend while having his back resting on resilient ball 400. The user bends his legs as shown in dotted line 301 and causes ball 400 to roll forward and backward in the process. Guide rails 4, 6 keep the ball 400 moving in a linear fashion.

Figure 4:
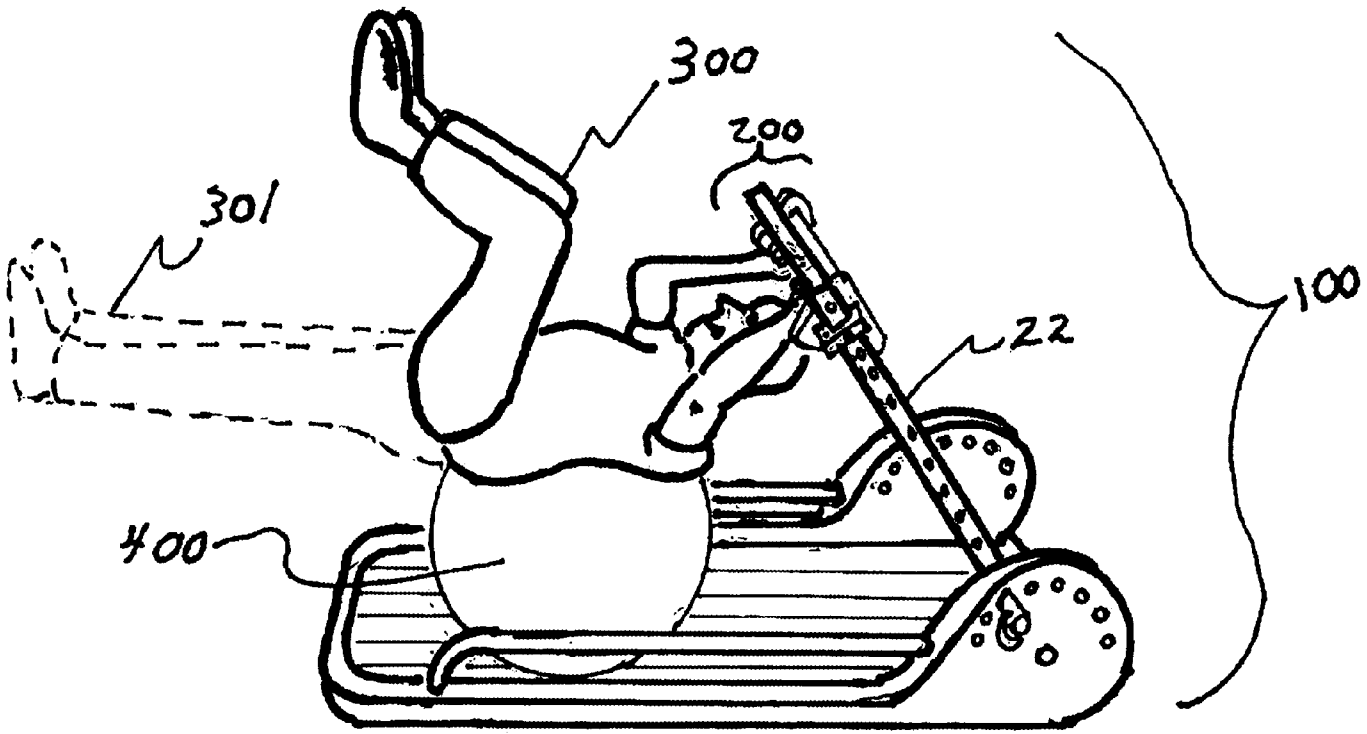
FIG. 4 is a perspective view of a person performing a leg lift using the present invention.

FIG. 4 shows a person 300,301 performing a leg lift using The present invention 100. In this case the user has positioned frame 22 in a forward position and is using bar 34 as a hand grasping means.

Figure 5:
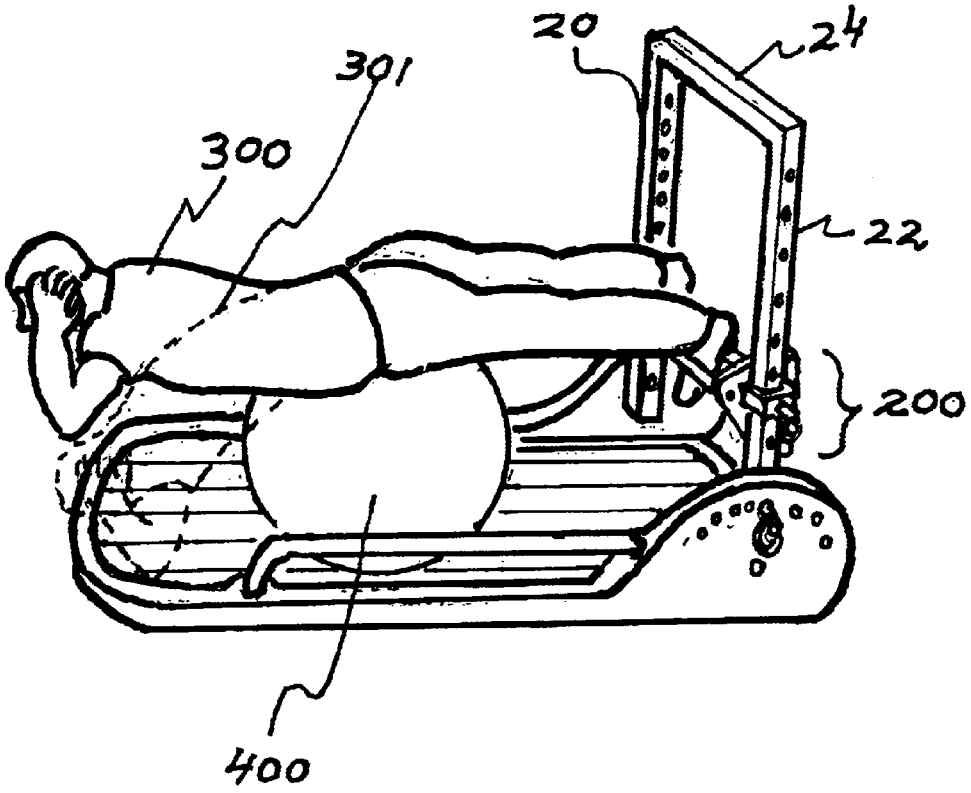
FIG. 5 is a perspective view of a person performing a back strengthening exercise using the present invention.

FIG. 5 shows a person 300,301 performing a back strengthening exercise using the present invention 100. Notice that the foot rest assembly 200 has been positioned towards the bottom of frame 22, 24, 20 so that the user's feet and legs are in an ideal position being parallel to the floor.

Obviously, many more exercises can be accommodated when using the present invention 100 in other configurations. The above descriptions and illustrations show that the present invention provides an ideal complement to the inflated resilient exercise balls that are now on the market. The present invention can be folded flat for easy storage and is economical to manufacture.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. Exercise apparatus comprising:

a base plate;

a pair of opposed flanges extending perpendicularly from the end and side of said base plate;

each said flange having a an aperture that receives a pin that acts as a shaft;

an inverted U shaped frame;

the free ends of said U shaped frame being connected to said shaft pins so that said U shaped frame can rotate about said shaft pins;

a plurality of radially spaced apertures in each said flange;

a single aperture in each said inverted U shaped frame that aligns with said radially spaced apertures;

a pair of connecting pins to retain said inverted U shaped frame to said flanges in a fixed position with respect to said base plate;

a foot retaining assembly slidibly mounted in a horizontal manner with respect to the base of said inverted U shaped frame;

said foot retaining assembly comprised of a plurality of foot retaining bars attached at each end to a side plate;

said side plate having a frame retaining connector;

said retaining connector having an aperture that can align with one of a plurality of spaced apertures located in each leg of said inverted U shaped frame;

a pair of retaining pins that can fix said foot retaining assembly higher or lower along said inverted U shaped frame; and said foot retaining bars being adjustable to allow for different sized feet.

2. Exercise apparatus as claimed in claim 1 wherein a pair of guide rods can be inserted so that they extend horizontally out from said flanges to the front edge of said base plate.

3. Exercise apparatus as claimed in claim 2 wherein said guide rails can slidably retain a resilient exercise ball in a linear rolling fashion.

4. Exercise apparatus as claimed in claim 1 wherein said exercise apparatus can be used in conjunction with an exercise ball to perform a variety of stretching and compression exercises.

* * * * *